US012433412B2

(12) United States Patent
Lin

(10) Patent No.: US 12,433,412 B2
(45) Date of Patent: Oct. 7, 2025

(54) RETRACTABLE FOOTREST FOR CHAIR

(71) Applicant: Chang-Chen Lin, Tainan (TW)

(72) Inventor: Chang-Chen Lin, Tainan (TW)

( * ) Notice: Subject to any disclaimer, the term of this patent is extended or adjusted under 35 U.S.C. 154(b) by 182 days.

(21) Appl. No.: 18/495,970

(22) Filed: Oct. 27, 2023

(65) Prior Publication Data

US 2025/0134263 A1 May 1, 2025

(51) Int. Cl.
*A47C 7/50* (2006.01)
*A47C 7/00* (2006.01)

(52) U.S. Cl.
CPC ..... *A47C 7/5062* (2018.08); *A47C 7/004* (2013.01)

(58) Field of Classification Search
CPC ..... A47C 7/5062; A47C 7/004
See application file for complete search history.

(56) References Cited

U.S. PATENT DOCUMENTS 3,873,152 A * 3/1975 Garas ..... A47C 1/0242 297/68
4,678,229 A * 7/1987 Ryan ..... A47C 1/025 248/408
9,351,574 B2 * 5/2016 Lin ..... A47C 1/0355

* cited by examiner

*Primary Examiner* — Adam C Ortiz
(74) *Attorney, Agent, or Firm* — Best & Flanagan LLP

(57) ABSTRACT

A chair comprises a base, a seat, a backrest, an operating unit, and a footrest. A first shaft is pivotably connected to a rear end of the seat. The operating unit includes a transmission member, a spring, and a first motor. An end of the transmission member is connected to the seat. An end of the spring is connected to another end of the transmission member. Another end of the spring is connected to the seat. The first motor has an end connected to the seat. The footrest is pivotably connected to a front end of the seat and incudes a second shaft interlocked with the transmission member. The first motor is operable in a direction to cause pivotal movement of the first shaft and to displace the transmission member to cause pivotal movement of the second shaft while stretching the spring, thereby moving the footrest to an extended position.

7 Claims, 6 Drawing Sheets

RETRACTABLE FOOTREST FOR CHAIR

BACKGROUND OF THE INVENTION

The present invention relates to a retractable foot rest and, more particularly, to a retractable foot rest for a chair.

A conventional chair generally includes a base, a seat, and a backrest. To increase the sitting comfort through supporting the legs, a footrest extending forward from the seat is provided. When not in use, the footrest is in a retracted position below the seat to reduce the volume of the chair. When in use, the footrest is extended forward to permit stretching of the legs of the person sitting in the chair while providing support.

To permit retracting/extending movement of the footrest relative to the seat, a connecting rod is disposed between the footrest and the seat. An end of the connecting rod is pivotably connected to a linking rod unit of the footrest, and the connecting rod can be moved manually or through electric control. Furthermore, the footrest can be pushed by the connecting rod to extend forward or retract rearward. Examples of the device is disclosed in U.S. Pat. Nos. 9,351,574 and 10,123,620.

However, forward or rearward movement of the footrest through direct actuation by the connecting rod tends to cause wear at the pivotal connection between the connecting rod and the footrest, such that the pivotal connection may have non-smooth pivotal movement or get stuck.

BRIEF SUMMARY OF THE INVENTION

An objective of the present invention is to provide a retractable footrest permitting smooth operation.

A chair according to the present invention comprises a base, a seat disposed above the base, a backrest connected to a rear end of the seat, an operating unit, and a footrest. The seat includes a first pivotal portion at the rear end thereof. A first shaft is pivotably connected to the first pivotal portion and includes a first connecting portion and a second connecting portion. The seat further includes a third connecting portion. The seat further includes a front end having two sides each having a fourth connecting portion. The operating unit includes a transmission member, a spring, and a first motor. An end of the transmission member is connected to the first connecting portion of the seat. An end of the spring is connected to another end of the transmission member. Another end of the spring is connected to the third connecting portion. The first motor is disposed on the seat and has an end connected to the second connecting portion. The footrest pivotably connected to the front end of the seat and incudes a second shaft interlocked with the transmission member. The first motor is operable in a direction to cause pivotal movement of the first shaft and to displace the transmission member to cause pivotal movement of the second shaft while stretching the spring, thereby moving the footrest to an extended position. The first motor is operable in a reverse direction to move the first shaft, the transmission member, and the second shaft in a reverse direction, and the footrest is returned to a retracted position under a returning force of the spring.

In an example, the transmission member is a chain, and a gear is disposed on the second axle and meshes with the chain.

In an example, the fourth connecting portion of the seat includes a first pivotal hole and a second pivotal hole. The first pivotal hole is an elongated hole. The footrest further includes two linking units symmetric to each other. Each of the two linking units includes a rectilinear first plate, a rectilinear second plate, a rectilinear third plate, a rectilinear fourth plate, and a supporting plate. Each of two ends of the second shaft is securely connected to an associated first plate. The footrest further includes two coupling pins each extending through an end of an associated first plate and pivotably coupled with and slidably received in an associated first pivotal hole. An end of the second plate and an end of the third plate of each of the two linking units are respectively and pivotably connected to two pivotal connecting portions on another end of an associated first plate. Another end of the second plate and another end of the third plate of each of the two linking units are respectively and pivotably connected to two pivotal connecting portions of the supporting plate. Each second plate includes a third pivotal hole. An end of each fourth plate is pivotably connected to an associated second pivotal hole. Another end of each fourth plate is pivotably connected to an associated third pivotal hole. Each fourth plate has a length permitting reduction in a volume of an associated linking unit in a retracted state. Each coupling pin is movable in an associated first pivotal hole when an associated linking unit moves from the retracted state to an extended state. The length of each fourth plate is smaller than a length of an associated linking unit in the extended state while an associated coupling pin is not displaceable.

In an example, the first pivotal hole is an elliptic hole having a longer axis extending in a vertical direction.

In an example, a rear fixing rod is disposed on the rear end of the seat. The rear fixing rod includes a third connecting portion and a rear assembling portion. The backrest includes a lower end having a lower engaging portion pivotably connected to the first pivotal portion of the seat. The lower end of the backrest includes a lower pivotal connection plate. The operating unit further includes a second motor having an end connected to the rear assembling portion of the seat and another end connected to the lower pivotal connection plate of the backrest. The second motor is configured to move the backrest to a vertical position or a rearward inclination position.

In an example, the base includes a post having a connecting frame on a top thereof. A movable frame is connected to the connecting frame and is pivotably connected to the seat. The seat is movable relative to the base in a vertical direction.

In an example, the movable frame includes a rear pivotal portion, a front pivotal portion, and an actuation portion. The rear pivotal portion is pivotably connected to the connecting frame. The front end of the seat includes a front assembling portion pivotably connected to the front pivotal portion of the movable frame. Another end of the first motor is pivotably connected to the actuation portion of the movable frame.

Since the length of the fourth plates are shortened, the footrest according to the present invention can be more retracted toward the seat, reducing the overall volume after retraction and thereby increasing the sense of quality. Furthermore, when the footrest is extended, the distance from the footrest to the ground can be increased. Thus, even the base has a lower height, the footrest can still be retracted and extended smoothly.

The first motor can be activated to actuate the first shaft, the transmission member, the second shaft, and the spring. Furthermore, rotation of the second shaft can actuate the first plates of the linking units and can extend or retract the linking units. Furthermore, when the second shaft rotates and, thus, actuates the footrest, a smoother operation of the footrest can be provided. This avoids wear at the pivotal connection between the connecting rod and the footrest in the conventional mechanism, such that the disadvantages of non-smooth pivotal movement or getting stuck of the pivotal connection can be avoided.

The present invention will become clearer in light of the following detailed description of illustrative embodiments of this invention described in connection with the drawings.

DETAILED DESCRIPTION OF THE INVENTION

Figure 1:
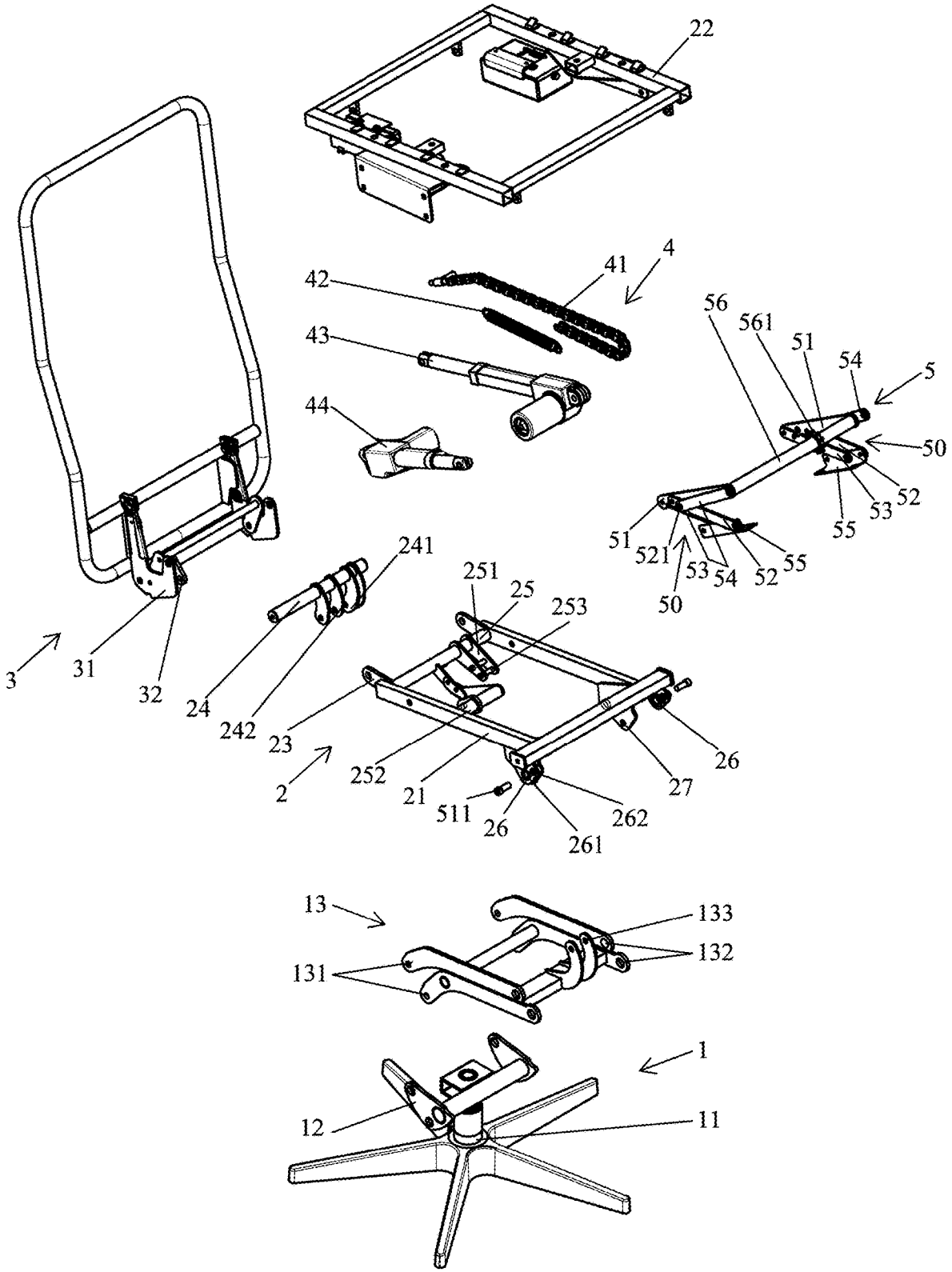
FIG. 1 is an exploded, perspective view of a chair of an embodiment according to the present invention.

Like elements having similar functions in the following embodiment of the present invention are designated by the same reference numbers, and some pivotal elements are omitted. Please refer to FIGS. 1-3 respectively illustrating an exploded-perspective view, a partial perspective view, and a side view of a chair of an embodiment according to the present invention. The chair comprises a base 1, a seat 2, a backrest 3, an operating unit 4, and a footrest 5. The base 1 includes a post 11 having a connecting frame 12 on a top thereof. A movable frame 13 is connected to the connecting frame 12. The movable frame 13 includes a rear pivotal portion 131, a front pivotal portion 132, and an actuation portion 133.

The seat 2 includes a first frame 21 and a second frame 22. The first frame 21 includes a rear end having a first pivotal portion 23. A first shaft 24 is pivotably connected to the first pivotal portion 23 and includes a first connecting portion 241 and a second connecting portion 242. A rear fixing rod 25 is disposed on a rear end of the first frame 21 and includes a third connecting portion 251 and a rear assembling portion 252. The third connecting portion 251 includes a hooking rod 253. The first frame 21 further includes a front end having two sides each having a fourth connecting portion 26. The fourth connecting portion 26 includes a first pivotal hole 261 and a second pivotal hole 262. The first pivotal hole 261 is an elongated elliptic hole having a longer axis extending in a vertical direction. The front end of the first frame 21 includes a front assembling portion 27 pivotably connected to the front pivotal portion 132 of the movable frame 13. The second frame 22 is disposed above the first frame 21, and a cushion (not shown) may be disposed on the second frame 22.

The backrest 3 includes a lower end having a lower engaging portion 31 pivotably connected to the first pivotal portion 23 of the seat 2. The lower end of the backrest 3 includes a lower pivotal connection plate 32.

The operating unit 4 including a transmission member 41, a spring 42, a first motor 43, and a second motor 44. The transmission member 41 may be in the form of a chain. The transmission member 41 may be of another type in other embodiments. An end of the transmission member 41 is connected to the first connecting portion 241 of the seat 2. An end of the spring 42 is connected to another end of the transmission member 41. Another end of the spring 42 is connected to the hooking rod 253 of the third connecting portion 251 of the seat 2. An end of the first motor 43 is connected to the second connecting portion 242 of the first shaft 24 of the seat 2. Another end of the motor 43 is connected to the actuation portion 133 of the movable frame 13. Thus, the first motor 43 can be activated to rotate the first shaft 24 and to move the transmission member 41. An end of the second motor 44 is connected to the rear assembling portion 252 of the seat 2. Another end of the second motor 44 is connected to the lower pivotal connection plate 32 of the backrest 3. The second motor 44 is configured to move the backrest 3 to a vertical position or a rearward inclination position.

The footrest 5 includes two linking units 50 symmetric to each other and a second shaft 56 interlocked with the transmission member 41. Each of the two linking units 50 includes a rectilinear first plate 51, a rectilinear second plate 52, a rectilinear third plate 53, a rectilinear fourth plate 54, and a supporting plate 55. The footrest 5 further includes two coupling pins 511 each extending through an end of an associated first plate 51 and pivotably coupled with and slidably received in an associated first pivotal hole 261. An end of the second plate 52 and an end of the third plate 53 of each of the two linking units 50 are respectively and pivotably connected to two pivotal connecting portions on another end of an associated first plate 51. Another end of the second plate 52 and another end of the third plate 53 of each of the two linking units 50 are respectively and pivotably connected to two pivotal connecting portions of the supporting plate 55. Each second plate 52 includes a third pivotal hole 521. An end of each fourth plate 54 is pivotably connected to an associated second pivotal hole 262. Another end of each fourth plate 54 is pivotably connected to an associated third pivotal hole 521. Each of two ends of the second shaft 56 is securely connected to an associated first plate 51. A gear 561 is disposed on the second axle 56 and meshes with the transmission member 41. Each fourth plate 54 has a length permitting retraction of an associated linking unit 50 to reduce the volume of the associated linking unit 50. When each linking unit 50 moves from a retracted state to an extended state, each coupling pin 511 moves upward in an associated first pivotal hole 511 to permit smooth extending. Furthermore, each fourth plate 54 may have a shorter length, such as smaller than a length of an associated linking unit 50 in the extended position while an associated coupling pin 511 is not displaceable.

Figure 4:
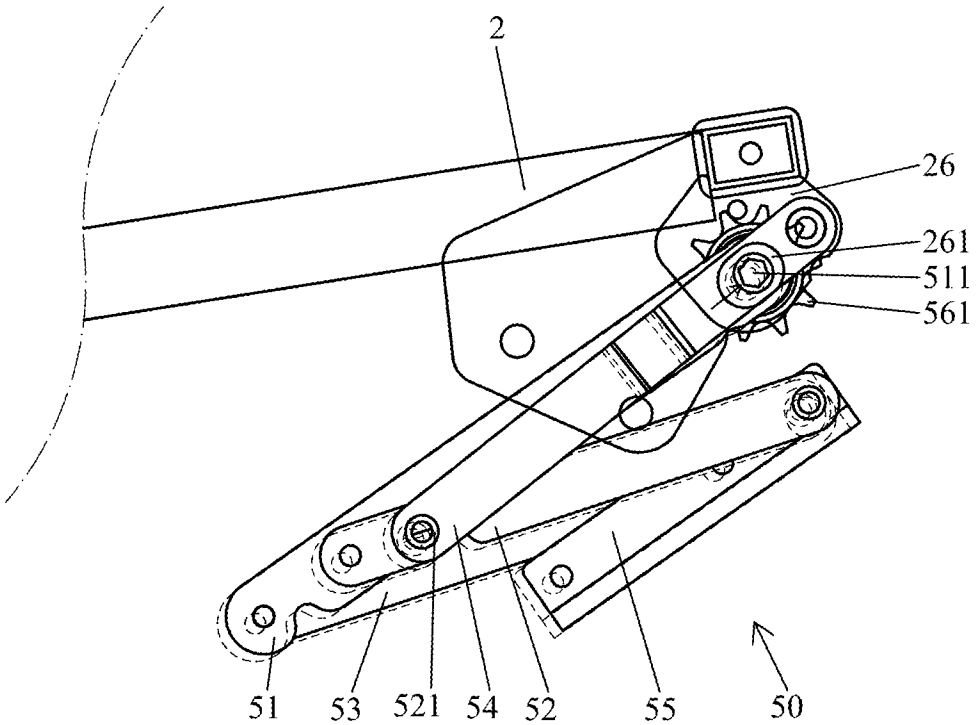
FIG. 4 is a schematic view illustrating extending of the footrest of the chair according to the present invention.
Figure 5:
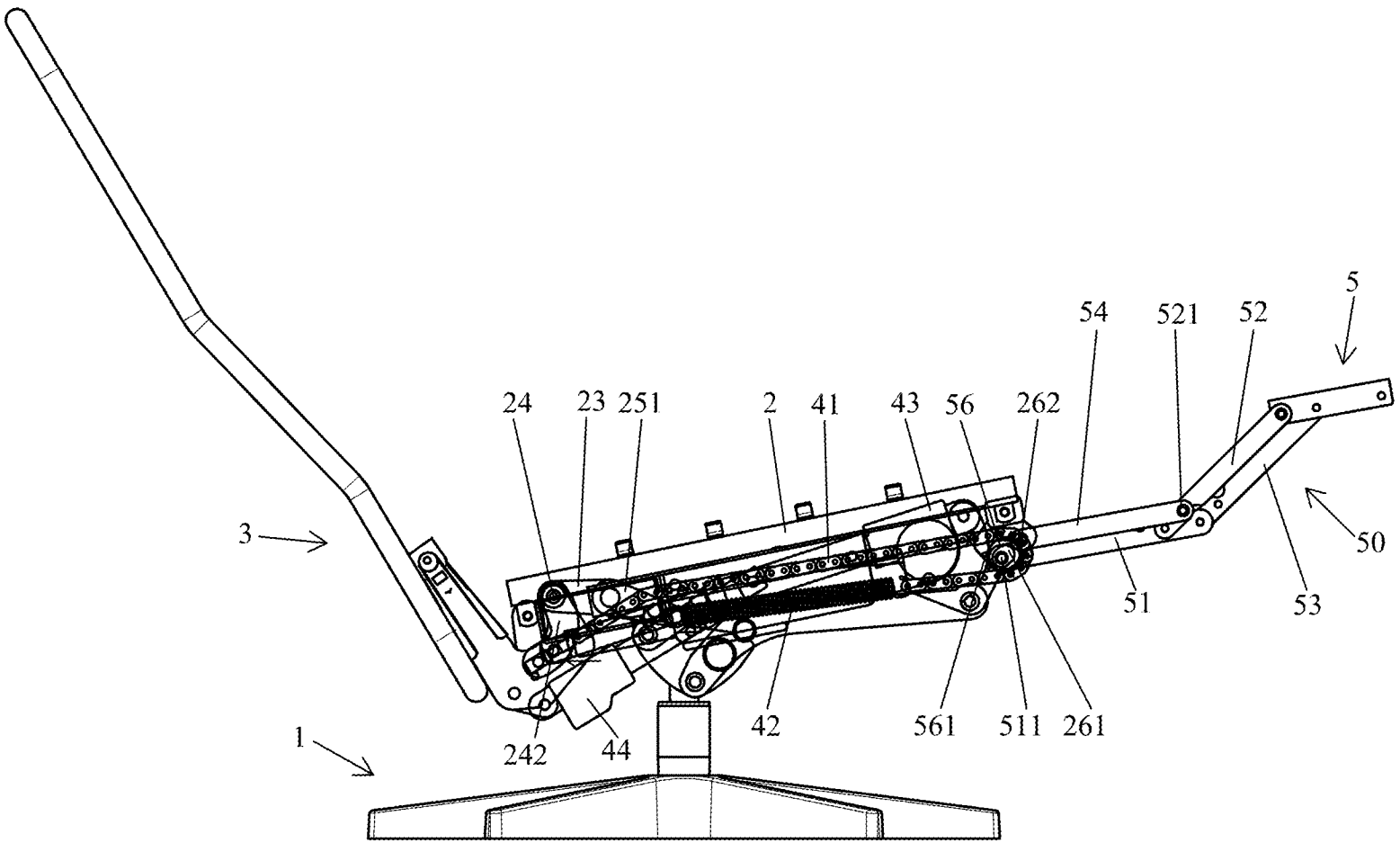
FIG. 5 is a side view of the chair according to the present invention, with the footrest in an extended state and with the backrest in a rearward inclination position.

Please refer to FIG. 4 illustrating extending of the footrest according to the present invention, wherein the transmission member 41 is omitted. Since each fourth plate 54 of the present invention is shorter, when the footrest 5 of this embodiment is extended to an extent of about 20-45 degrees, the position of the pivotal axis of each fourth plate 54 is different from the position of the pivotal axis of an associated first plate 51 (see the phantom lines), such that smooth pivotal movement is not permitted. In this case, the position of the associated first plate 51 and the position of the associated coupling pin 511 in the associated first pivotal hole 261 permit relative displacement therebetween, such that the pivotal axes thereof become coincident with each other, thereby permitting smooth extending operation of the associated linking unit 50.

When it is desired to retract the footrest 5 according to the present invention, since the length of the fourth plates 54 are shortened, the footrest 5 can be more retracted toward the seat 2, reducing the overall volume after retraction and thereby increasing the sense of quality. Furthermore, when the footrest 5 is extended, the distance from the footrest 5 to the ground can be increased. Thus, even the base 1 has a lower height, the footrest 5 can still be retracted and extended smoothly.

With reference to FIGS. 1, 2, 4, and 5, when it is desired to move the footrest 5 from the retracted position to the extended position, the first motor 43 can be activated to drive the first shaft 24 to rotate, which, in turn, causes displacement of the transmission member 41, thereby rotating the second shaft 56 and stretching the spring 42. Furthermore, rotation of the second shaft 56 actuates the first plate 51 of each linking unit 50, thereby extending each linking unit 50 to provide support for the legs of a user.

The displacement of the footrest 5 actuated by rotation of the second shaft 56 according to the present invention is not the same as the conventional mechanism which uses a linking rod (not shown). Namely, the extending operation of the footrest 5 is smoother. This avoids wear at the pivotal connection between the connecting rod and the footrest in the conventional mechanism, such that the disadvantages of non-smooth pivotal movement or getting stuck of the pivotal connection can be avoided. Furthermore, according to the present invention, the second motor 44 can be activated to move the backrest 3 to a rearward inclination state, improving the sitting comfort.

Figure 2:
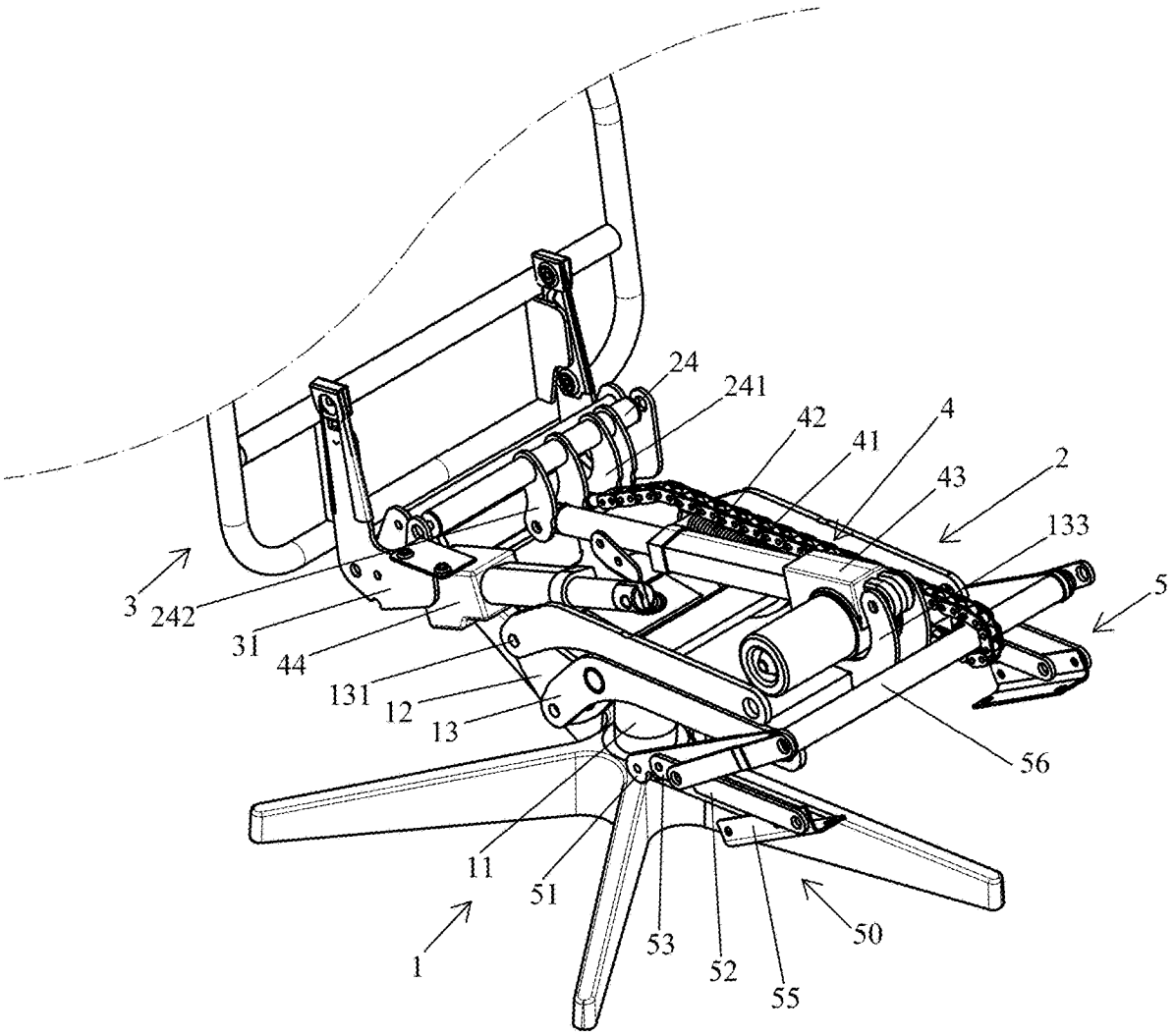
FIG. 2 is a partial, perspective view of the chair according to the present invention after assembly.
Figure 3:
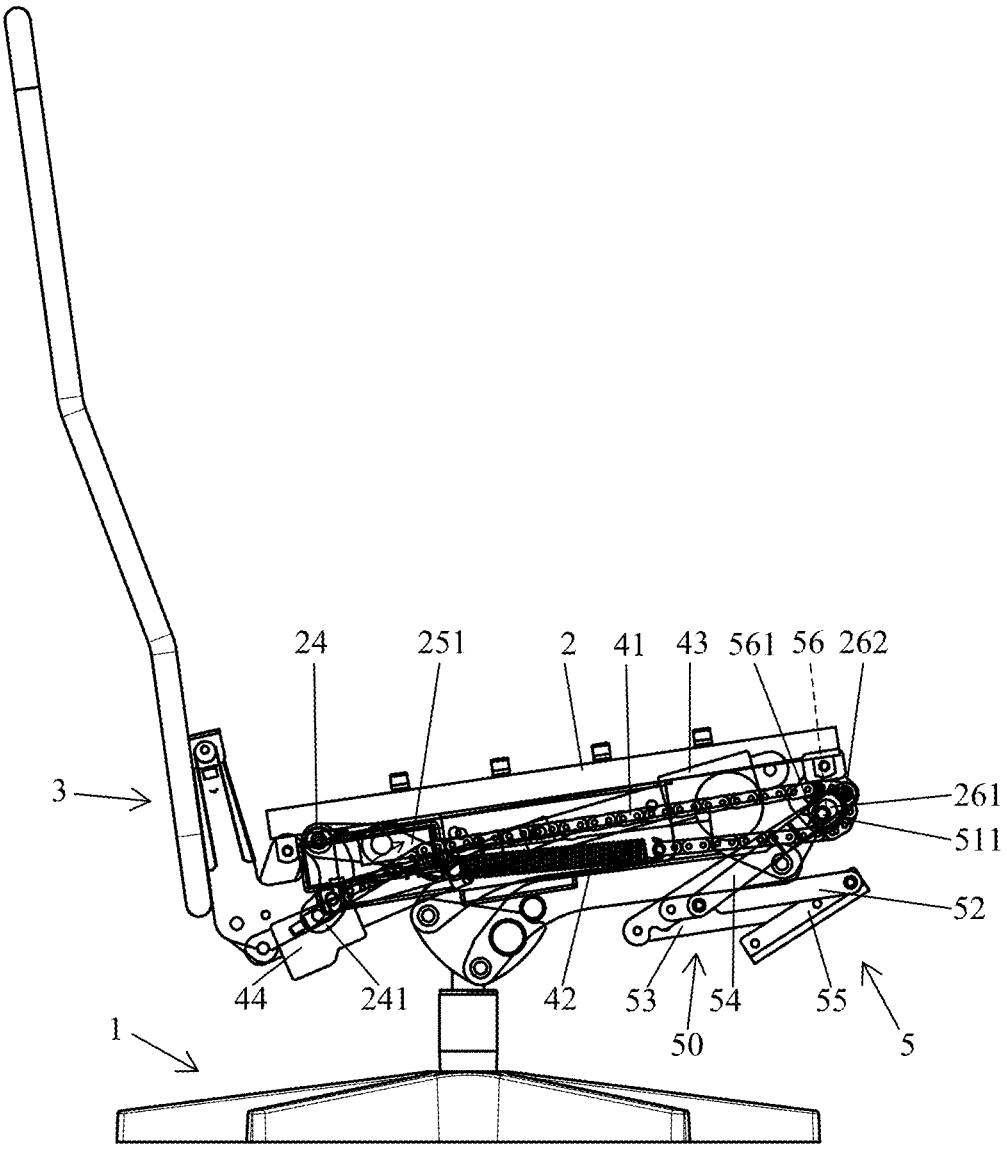
FIG. 3 is a side view of the chair according to the present invention, with a footrest in a retracted position and with a backrest in upright position.

With reference to FIGS. 1-3, according to the present invention, the second motor 44 can be activated to move the backrest 3 to the upright position, and the first motor 43 can be activated to rotate the first shaft 24 in a reverse direction. The returning force of the spring 42 pulls the transmission member 41 in a reverse direction, and the second shaft 56 rotates in a reverse direction, permitting retraction of the footrest 5. Furthermore, during retraction of the footrest 5, each coupling pin 511 can move in an associated first pivotal hole 261, permitting smooth retraction. Furthermore, the footrest 5 can be more retracted toward the seat 2 to reduce the volume after retraction.

Figure 6:
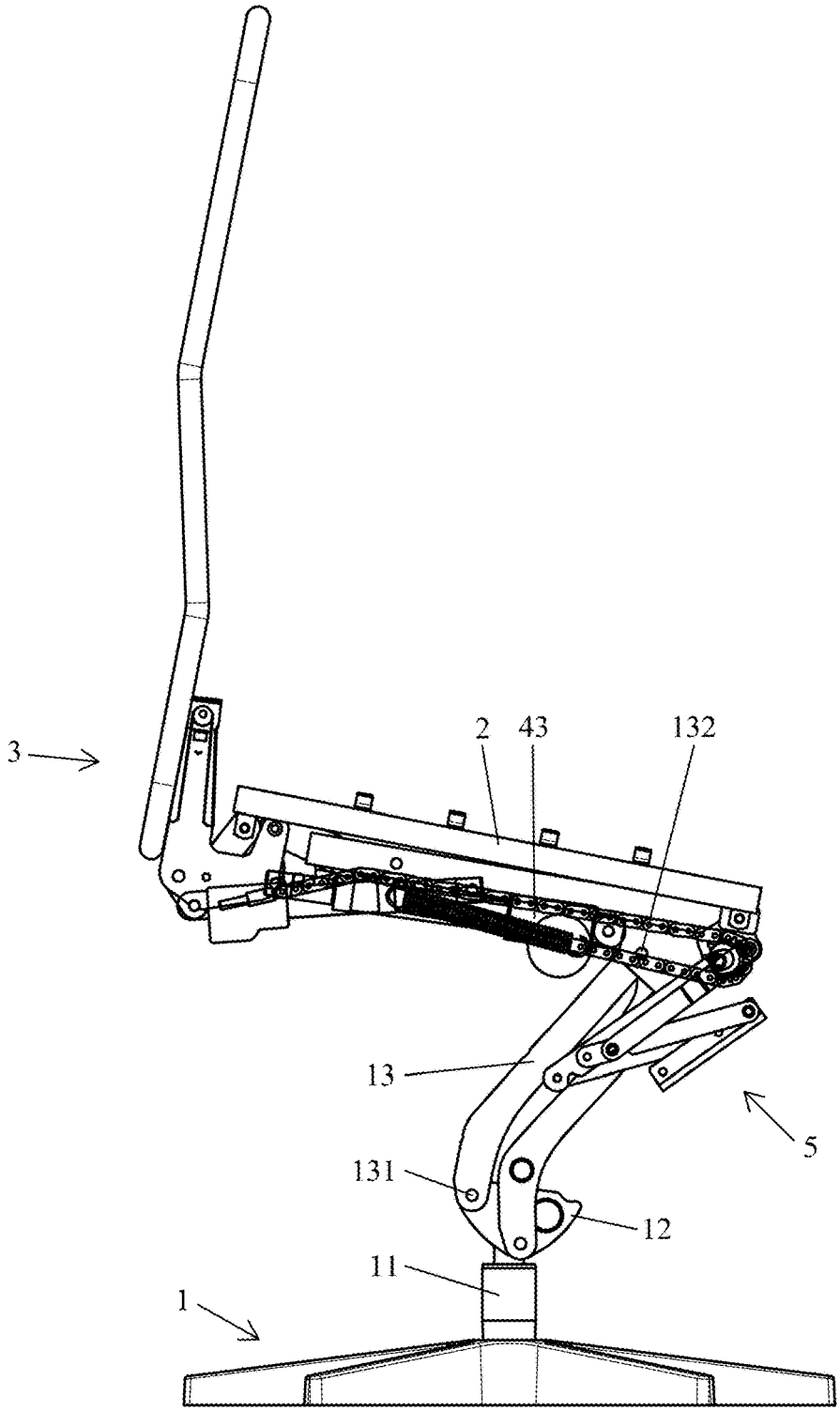
FIG. 6 is a side view of the chair according to the present invention, with a seat in a lifted state.

With reference to FIG. 6 illustrating the seat 2 in a lifted state, the first motor 43 can be activated to move the movable frame 13 relative to the base 1. The movable frame 13 actuates the seat 2 to move upward and rearward, permitting the user to get up from the chair easily. Furthermore, since the footrest 5 is retracted to a position closer to the seat 2, the footrest 5 will not protrude beyond the seat 2 to a large extent, which permits the user to get up more easily.

In view of the foregoing, the chair according to the present invention provides smooth operation and enhanced retraction effect of the footrest 5. Furthermore, the base 2 may be directly coupled to the base 1 without the movable frame 13. Furthermore, the other end of the first motor 43 can be directly coupled with the seat 2. Furthermore, the relative inclination angle between the backrest 3 and the seat 2 can be adjusted manually without disposition of the second motor 44.

Although specific embodiments have been illustrated and described, numerous modifications and variations are still possible without departing from the scope of the invention. The scope of the invention is limited by the accompanying claims.

The invention claimed is:

1. A chair comprising:

a base;

a seat disposed above the base, wherein the seat includes a first pivotal portion at a rear end thereof, wherein a first shaft is pivotably connected to the first pivotal portion and includes a first connecting portion and a second connecting portion, wherein the seat further includes a third connecting portion, and wherein the seat further includes a front end having two sides each having a fourth connecting portion;

a backrest connected to the rear end of the seat;

an operating unit including a transmission member, a spring, and a first motor, wherein an end of the transmission member is connected to the first connecting portion of the seat, wherein an end of the spring is connected to another end of the transmission member, wherein another end of the spring is connected to the third connecting portion, wherein the first motor is disposed on the seat and has an end connected to the second connecting portion;

a footrest pivotably connected to the front end of the seat, wherein the footrest incudes a second shaft interlocked with the transmission member, wherein the first motor is operable in a direction to cause pivotal movement of the first shaft and to displace the transmission member to cause pivotal movement of the second shaft while stretching the spring, thereby moving the footrest to an extended position, and wherein the first motor is operable in a reverse direction to move the first shaft, the transmission member, and the second shaft in a reverse direction, and the footrest is returned to a retracted position under a returning force of the spring.

2. The chair as claimed in claim 1, wherein the transmission member is a chain, and a gear is disposed on the second axle and meshes with the chain.

3. The chair as claimed in claim 1, wherein the fourth connecting portion of the seat includes a first pivotal hole and a second pivotal hole, wherein the first pivotal hole is an elongated hole, wherein the footrest further includes two linking units symmetric to each other, wherein each of the two linking units includes a rectilinear first plate, a rectilinear second plate, a rectilinear third plate, a rectilinear fourth plate, and a supporting plate, wherein each of two ends of the second shaft is securely connected to an associated first plate, wherein the footrest further includes two coupling pins each extending through an end of an associated first plate and pivotably coupled with and slidably received in an associated first pivotal hole, wherein an end of the second plate and an end of the third plate of each of the two linking units are respectively and pivotably connected to two pivotal connecting portions on another end of an associated first plate, wherein another end of the second plate and another end of the third plate of each of the two linking units are respectively and pivotably connected to two pivotal connecting portions of the supporting plate, wherein each second plate includes a third pivotal hole, wherein an end of each fourth plate is pivotably connected to an associated second pivotal hole, wherein another end of each fourth plate is pivotably connected to an associated third pivotal hole, wherein each fourth plate has a length permitting reduction in a volume of an associated linking unit in a retracted state, wherein each coupling pin is movable in an associated first pivotal hole when an associated linking unit moves from the retracted state to an extended state, wherein the length of each fourth plate is smaller than a length of an associated linking unit in the extended state while an associated coupling pin is not displaceable.

4. The chair as claimed in claim 3, wherein the first pivotal hole is an elliptic hole having a longer axis extending in a vertical direction.

5. The chair as claimed in claim 1, wherein a rear fixing rod is disposed on the rear end of the seat, wherein the rear fixing rod includes a third connecting portion and a rear assembling portion, wherein the backrest includes a lower end having a lower engaging portion pivotably connected to the first pivotal portion of the seat, wherein the lower end of the backrest includes a lower pivotal connection plate, wherein the operating unit further includes a second motor having an end connected to the rear assembling portion of the seat and another end connected to the lower pivotal connection plate of the backrest, and wherein the second motor is configured to move the backrest to a vertical position or a rearward inclination position.

6. The chair as claimed in claim 1, wherein the base includes a post having a connecting frame on a top thereof, wherein a movable frame is connected to the connecting frame and is pivotably connected to the seat, and wherein the seat is movable relative to the base in a vertical direction.

7. The chair as claimed in claim 6, wherein the movable frame includes a rear pivotal portion, a front pivotal portion, and an actuation portion, wherein the rear pivotal portion is pivotably connected to the connecting frame, wherein the front end of the seat includes a front assembling portion pivotably connected to the front pivotal portion of the movable frame, and wherein another end of the first motor is pivotably connected to the actuation portion of the movable frame.

* * * * *